US008355238B2

(12) United States Patent
Lee et al.

(10) Patent No.: US 8,355,238 B2
(45) Date of Patent: Jan. 15, 2013

(54) ION GENERATOR AND HEAT DISSIPATION DEVICE USING THE SAME

(75) Inventors: Chi-Hsiung Lee, Jhongli (TW); Tsung-Liang Hung, Jhongli (TW); Nai-Chun Chang, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 392 days.

(21) Appl. No.: 12/713,313

(22) Filed: Feb. 26, 2010

(65) Prior Publication Data

US 2010/0328837 A1 Dec. 30, 2010

(30) Foreign Application Priority Data

Jun. 29, 2009 (CN) ..... 2009 2 0305285

(51) Int. Cl.
*H01T 23/00* (2006.01)

(52) U.S. Cl. ..... 361/231; 361/230

(58) Field of Classification Search ..... 361/230, 361/231

See application file for complete search history.

(56) References Cited

U.S. PATENT DOCUMENTS

| | | | | |
|---|---|---|---|---|
| 6,228,149 | B1 * | 5/2001 | Alenichev et al. | 95/78 |
| 7,452,411 | B2 * | 11/2008 | Volodina et al. | 96/66 |
| 2004/0170542 | A1 * | 9/2004 | Taylor | 422/186.04 |

* cited by examiner

*Primary Examiner* — Jared Fureman
*Assistant Examiner* — Scott Bauer
(74) *Attorney, Agent, or Firm* — Altis Law Group, Inc.

(57) ABSTRACT

An ion generator to generate ion flow to ventilate heat comprises an emitter, a receiver and a power supply. The emitter comprises a needle electrode having one needle shaped tip configured as a discharging portion. The receiver comprises a plurality of flow channels for airflow and at least one receiving portion. The at least one receiving portion comprises a line edge arranged around a concave spherical surface, and the discharging portion is at a substantial center of the concave spherical surface. The power supply provides a voltage potential difference between the discharging portion of the emitter and the receiving portions of the receiver.

20 Claims, 9 Drawing Sheets

ION GENERATOR AND HEAT DISSIPATION DEVICE USING THE SAME

BACKGROUND

1. Technical Field

Embodiments of the present disclosure relate to heat dissipation devices, and particularly to a heat dissipation device with an ion generator.

2. Description of Related Art

Electronic components in electronic devices, such as central processing units (CPUs) and power supplies, generate vast amounts of heat during operation. As more electronic components are employed in an electronic device, more heat is generated and accumulated. The heat that accumulates inside the electronic device is prone to cause overheating. In general, the electronic devices utilize fans to ventilate heat. However, vibrations and friction on motors and blades of the fans not only make noises, but also generate extra heat. Therefore, heat dissipation devices with better performance than the fans are considerably required.

BRIEF DESCRIPTION OF THE DRAWINGS

Many aspects of the embodiments can be better understood with references to the following drawings, wherein like numerals depict like parts, and wherein.

DETAILED DESCRIPTION

Figure 1:
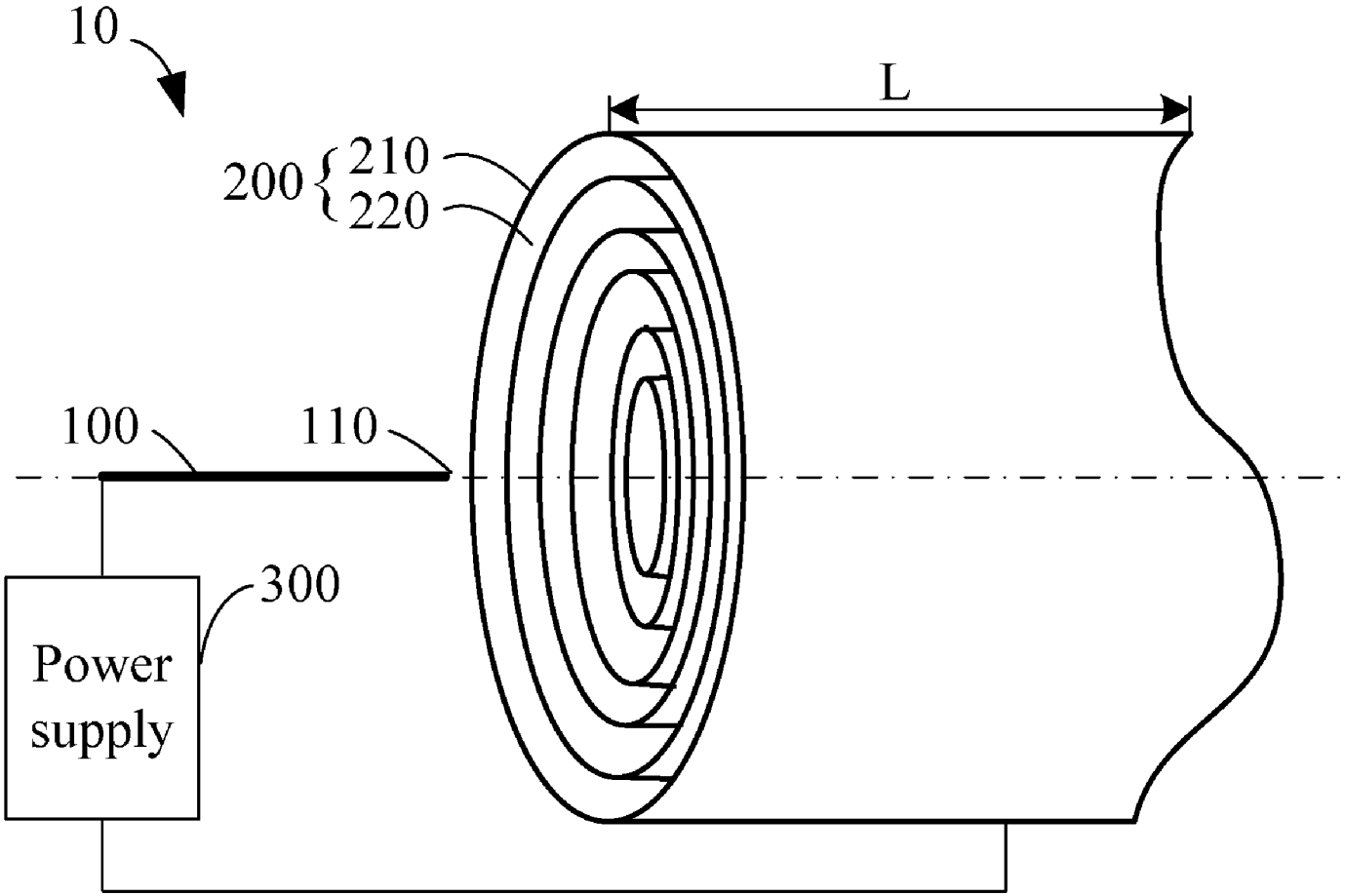
FIG. 1 illustrates an ion generator of a first embodiment of the present disclosure.
Figure 2:
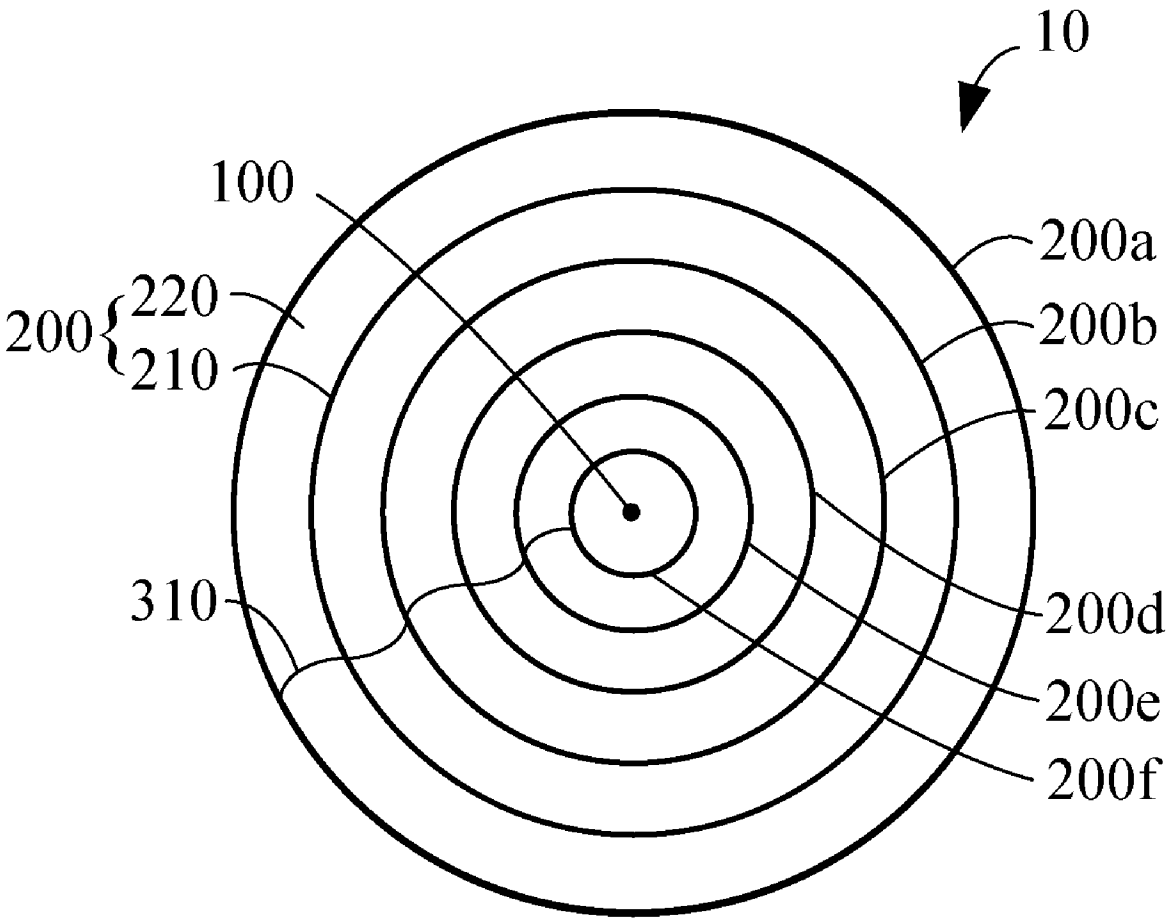
FIG. 2 is a front view of the ion generator of a first embodiment of the present disclosure shown in FIG. 1.

Referring to FIG. 1 and FIG. 2, an ion generator 10 according to one embodiment of the present disclosure is shown. The ion generator 10 comprises an emitter 100, a receiver 200, and a power supply 300. The emitter 100 comprises a needle electrode with one end configured as a discharging portion 110. The receiver 200 comprises at least one receiving portion 210, and a plurality of flow channels 220 for airflow. The at least one receiving portion 210 comprises a line edge arranged around a concave spherical surface. The discharging portion 110 is at the center of the concave spherical surface. The power supply 300 supplies a voltage potential difference with at least 1500 volts between the discharging portion 110 of the emitter 100 and the receiving portion 210 the receiver 200.

In the embodiment, the discharging portion 110 is a needle shaped tip having a greater curvature than that of the receiving portions 210. The receiver 200 comprises a plurality of coaxial metal tubes 200*a*-200*f* electrically connected together via a power line 310. Therefore, the coaxial metal tubes 200*a*-200*f* are equipotential. In one embodiment, all the coaxial metal tubes 200*a*-200*f* are circular with a length L. Each of the coaxial metal tubes 200*a*-200*f* comprises one end toward the discharging portion 110 of the emitter 100, and the other end connected to the power supply 300. A line edge of the one end of each coaxial metal tube is configured as the receiving portion 210. Interspaces between the coaxial metal tubes 200*a*-200*f* form the flow channels 220. In other alternative embodiments, the length L of the coaxial metal tubes 200*a*-200*f* is variable to meet practical requirements. Particularly, each of the coaxial metal tubes 200*a*-200*f* is shortened to form a coaxial metal ring to save materials and miniaturize the ion generator 10.

Figure 3:
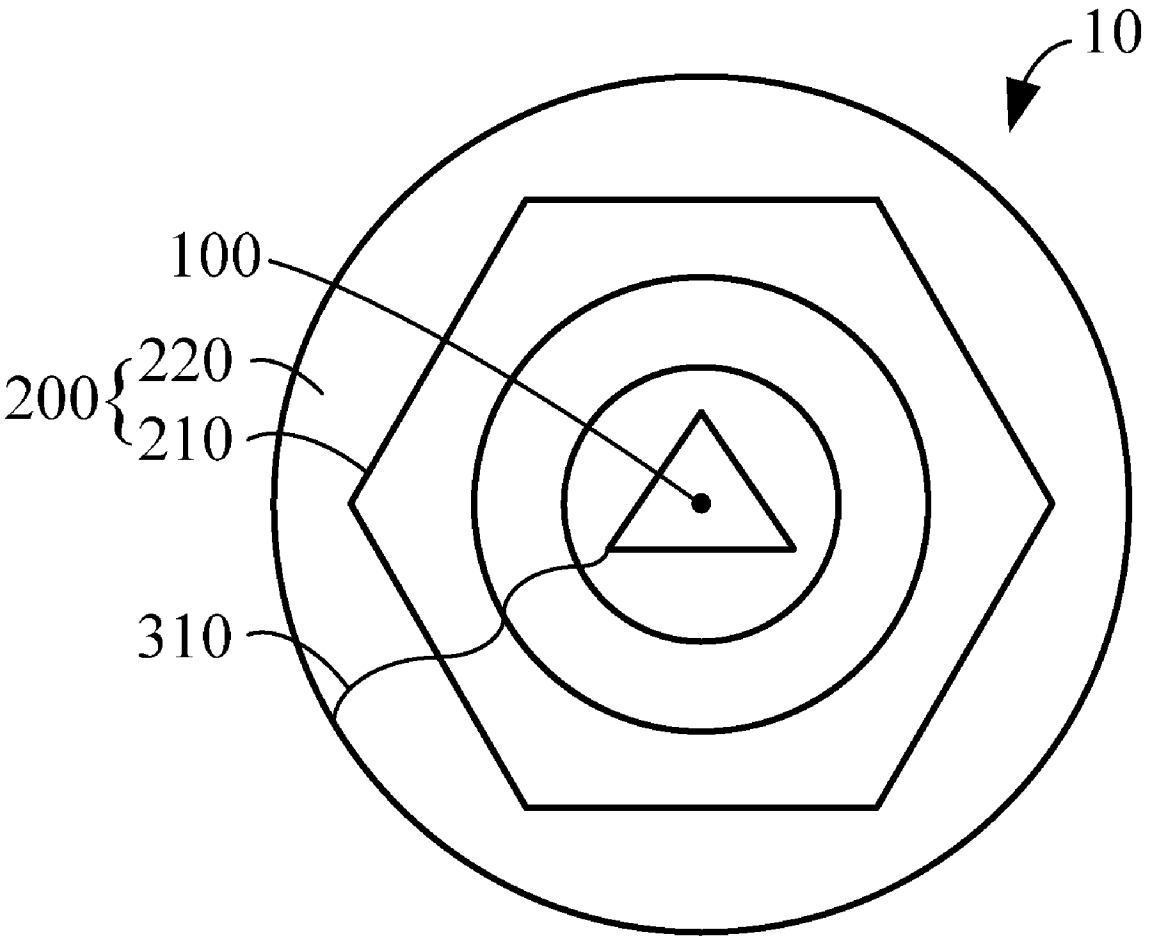
FIG. 3 illustrates an ion generator of a second embodiment of the present disclosure.
Figure 4:
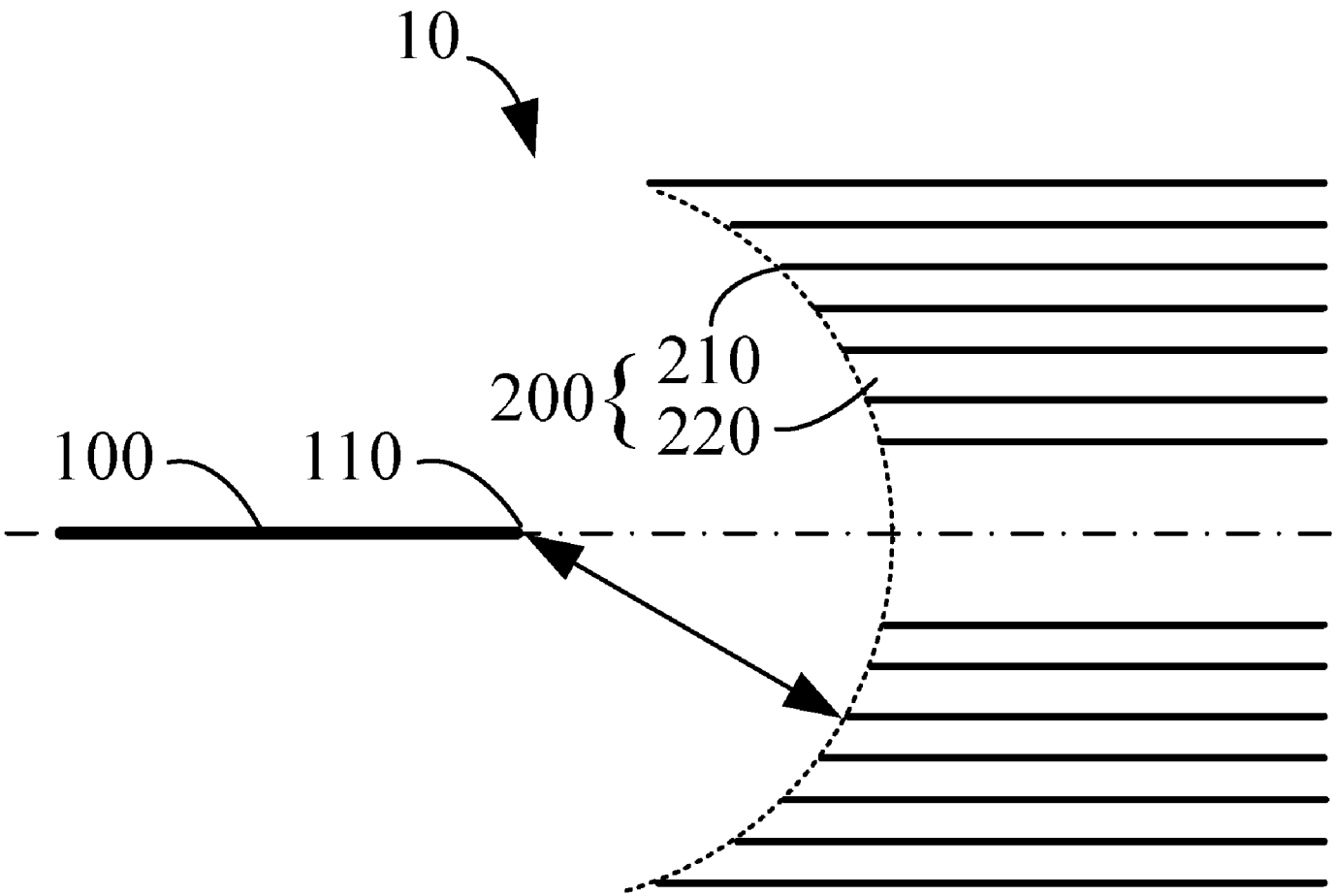
FIG. 4 is a cross section view of the ion generators in FIG. 1, FIG. 2 and FIG. 3.

In present disclosure, distances from the receiving portions 210 of the receiver 200 to the discharging portion 110 of the emitter 100 are substantially the same, which can be better viewed in FIG. 4 which shows a cross section view of the ion generator 10 of FIG. 1. As specifically shown in FIG. 4, the receiving portions 210 of the receiver 200 are arranged around the concave spherical surface of which the discharging portion 110 is at the center. It should be understood that the distance from each receiving portion 210 to the discharging portion 110 is equal to the radius of the concave sphere surface, to ensure the discharging portion 110 is operable to discharge. In alternative embodiments, the coaxial metal tubes of the receiver 200 can be various shapes, such as triangle and polygon as shown in FIG. 3, for example. Correspondingly, the alternative modifications in FIG. 3 are also available for the coaxial metal rings.

In the embodiment, the ion generator 10 is disposed next to heat sources, such as central processing units (CPU) or power supplies, for example, of an electronic device (not shown). When the power supply 300 is turned on, the voltage potential difference with at least 1500 volts is established between the discharging portion 110 of the emitter 100 and the receiving portions 210 of the receiver 200. Consequently, the ion generator 10 ionizes the air around the discharging portion 110 to generate ions. The electric field between the discharging portion 110 and the receiving portions 210 forces the generated ions to flow along electronic field lines from the discharging portion 110 to the receiving portion 210. Correspondingly, the airflow through the flow channels 220. In the embodiment, the airflow ventilates the heat through the flow channels 220, so there is no vibration and friction on the ion generator 10 to make noises.

In the embodiment, intensities of the electric field between the receiving portions 210 and the discharging portion 110 are substantially the same due to the same distance therebetween. Accordingly, amounts of ions flowing from the discharging portion 110 to the receiving portions 210 are the same. Therefore, each of the flow channels 220 between the coaxial metal tubes has airflow with the same intensity. Consequently, the heat is proportionately dispersed into the flow channels 220 of the coaxial metal tubes, and the heat is dissipated more quickly than the gathered one. Thus, the heat dissipation performance improves considerably.

According to alternative embodiments of the present disclosure, the receiver 200 of the ion generator 10 may have various structures with a common character, that is, the receiver 200 comprises a plurality of receiving portions 210 of line edge arranged around the concave spherical surface of which the discharging portion 110 is at the center. Specifically, some preferred alternative embodiments are listed bellow. As operations of the ion generators, according to the alternative embodiments are substantially similar to those of the ion generator 10 in FIG. 1, the differences are simply mentioned.

Figure 5:
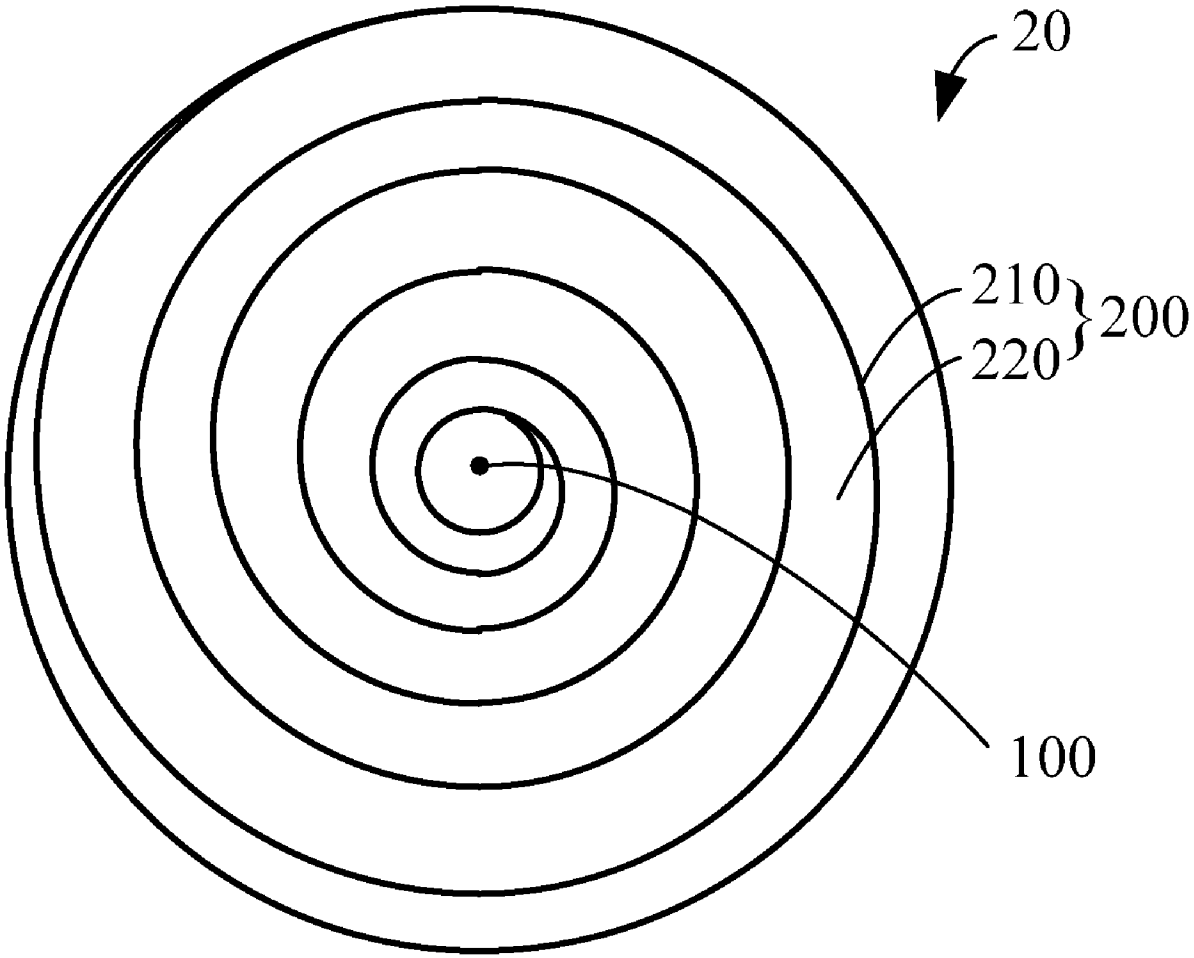
FIG. 5 illustrates an ion generator of a third embodiment of the present disclosure.

Referring to FIG. 5, an ion generator 20 according to one alternative embodiment of the present disclosure is shown. The ion generator 20 comprises an emitter 100 with the same structure as that of the ion generator 10 shown in FIG. 1, and a receiver 200 comprising a swirling metal tube. The swirling metal tube comprises one end toward the discharging portion 110 of the emitter 100. A line edge of the one end is configured as the receiving portion 210 of the receiver 200, and arranged around the concave spherical surface of which the discharging portion 110 is at the center. The ion generator 20 has an approximate cross section view as the ion generator 10 shown in FIG. 4, which can be omitted.

In the embodiment, the receiver 210 comprises the swirling metal tubes of circular shape. In alternative embodiment, the receiver 210 may comprises a swirling metal tube of various shapes, such as triangle and polygon, for example. Additionally, the length of the swirling metal tube is variable to meet practical requirements as the length L of the coaxial metal tubes in FIG. 1. Particularly, the swirling metal tube is shortened to form a swirling metal ring in order to save material and miniaturize the ion generator 20.

The ion generator 20 operates in the same way as the ion generator 10, and the airflow through the interspaces of the swirling metal tube ventilates the heat correspondingly. In the embodiment, the interspaces of the swirling metal tube form the flow channels 220.

Figure 6:
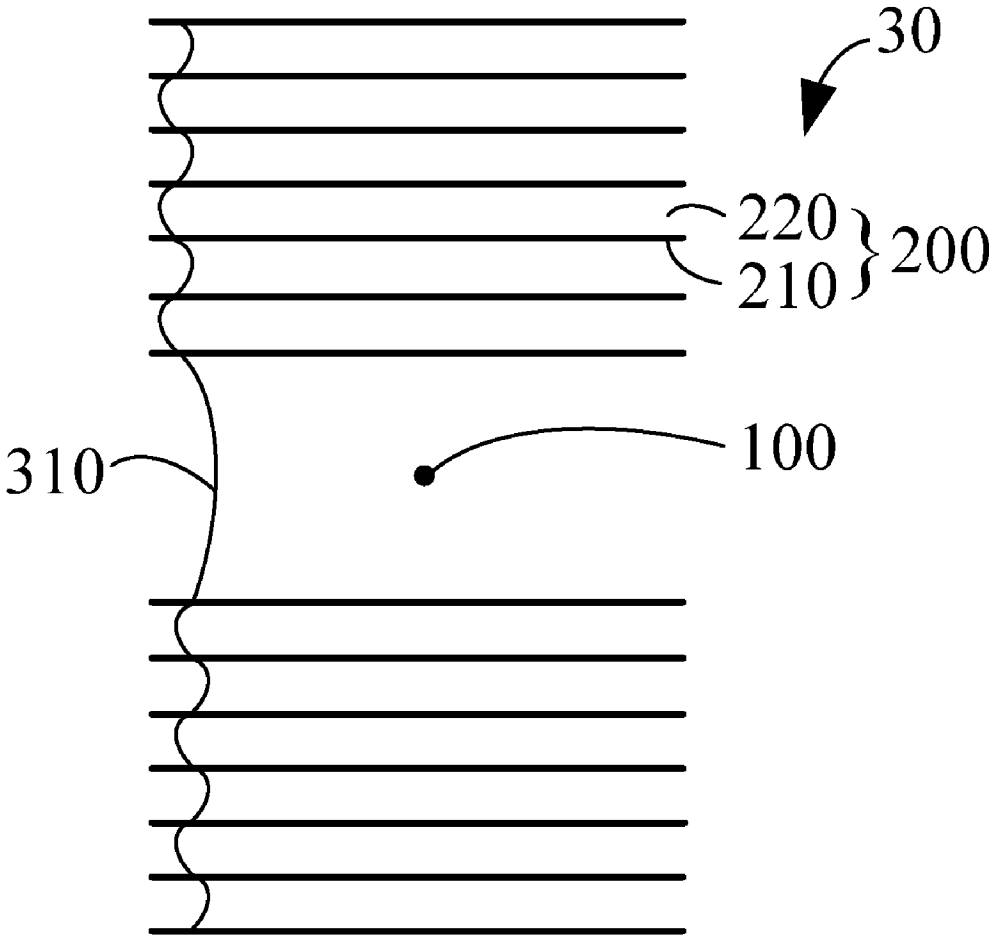
FIG. 6 illustrates an ion generator of a fourth embodiment of the present disclosure.

Referring to FIG. 6, an ion generator 30 according to another alternative embodiment of the present disclosure is shown. The ion generator 30 comprises an emitter 100 with the same structure as that of the ion generator 10 shown in FIG. 1, and a receiver 200 comprising a plurality of metal plates electrically connected together via the power line 310. Therefore, the metal plates are equipotential. Normally, each of the metal plates comprises a top surface, a bottom surface and four sides around the top and bottom surfaces.

In one embodiment, one side of each metal plate perpendicular to the emitter 100 is toward the discharging portion 110 of the emitter 100 with a concave line edge. The concave line edge of the one side of each metal plate is configured as the receiving portion of the receiver 200, and arranged around the concave spherical surface of which the discharging portion 110 is at the center. In alternative embodiments, the length of the other two sides of each metal plate parallel with the emitter 100 are variable to meet practical requirements as the length L of the coaxial metal tubes in FIG. 1. Particularly, each metal plate is shortened to form a metal column in order to save materials and miniaturize the ion generator 30.

The ion generator 30 operates in the same way as the ion generator 10, and the airflow through the interspaces between the metal plates ventilates the heat correspondingly. In the embodiment, the interspaces between the metal plates form the flow channels 220.

Figure 7:
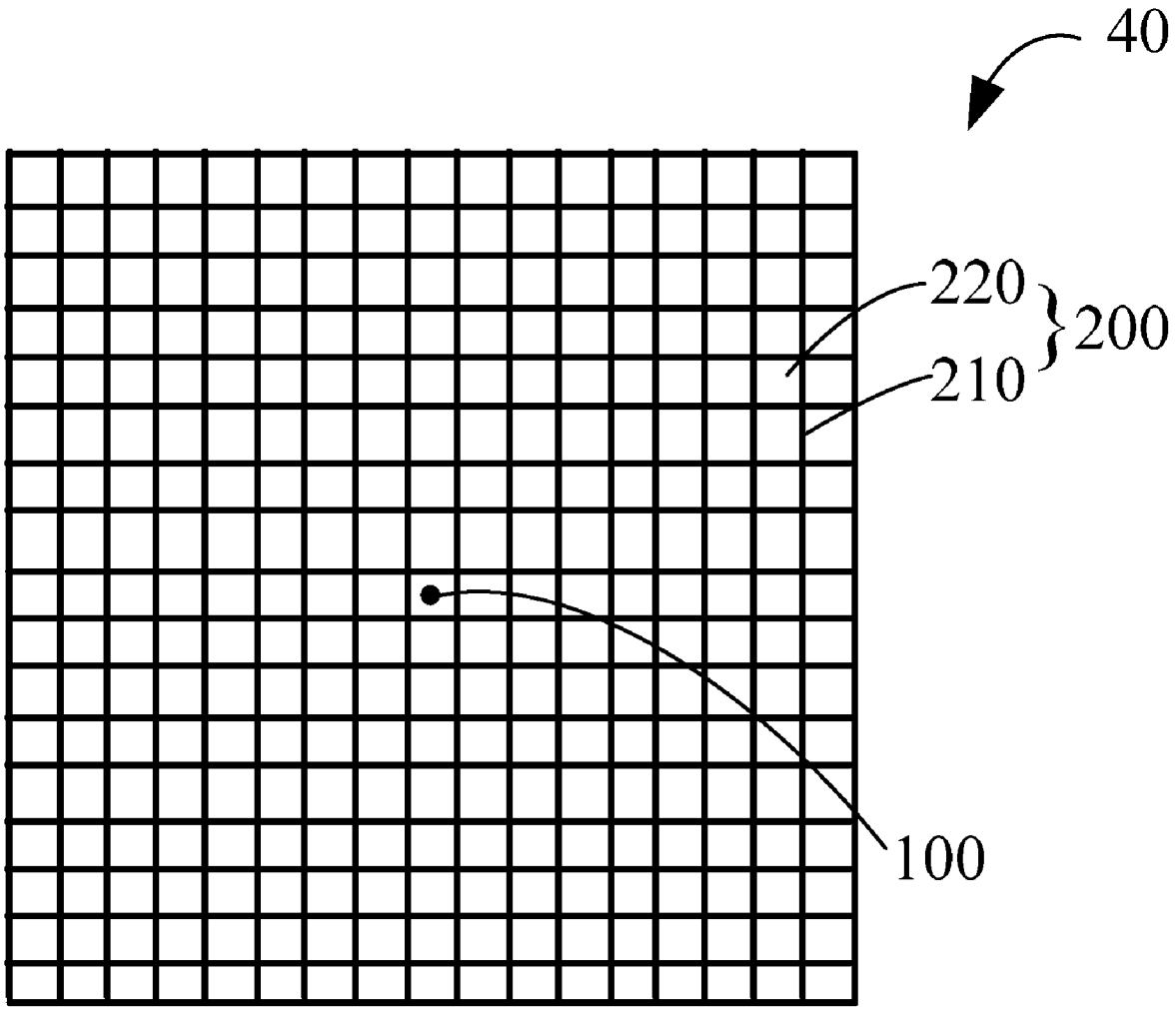
FIG. 7 illustrates an ion generator of a fifth embodiment of the present disclosure.

Referring to FIG. 7, an ion generator 40 according to another alternative embodiment of the present disclosure is shown. The ion generator 40 comprises an emitter 100 with the same structure as that of the ion generator 10 shown in FIG. 1, and a receiver 200 comprising a metal board with a plurality of holes. In the embodiment, the holes of the metal board are rectangle. In alternative embodiments, the metal board may have holes of various shapes, such as triangle, circle, etc.

In the embodiment, the metal board comprises two surfaces and has a thickness. Line edges on one of the two surfaces are arranged around the concave spherical surface of which the discharging portion 110 is at the center, and configured as the receiving portions of the receiver 200. In alternative embodiments, the thickness of the metal board is variable to meet practical requirements as the length L of the coaxial metal tubes in FIG. 1. Particularly, the metal board is thinned to form a metal net in order to save materials and miniaturize the ion generator 40.

The ion generator 40 operates in the same way as the ion generator 10, and the airflow through the holes of the metal board ventilates the heat correspondingly. In the embodiment, the holes of the metal board form the flow channels 220.

Figure 8:
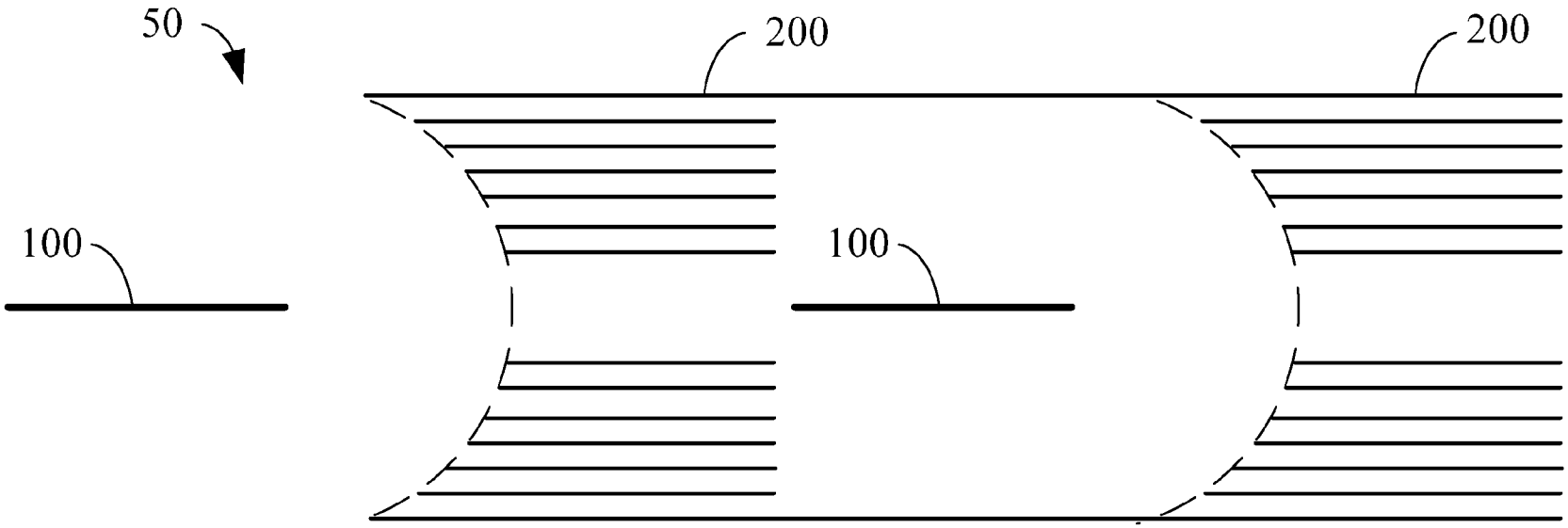
FIG. 8 illustrates a heat dissipation device of a first embodiment of the present disclosure.

Referring to FIG. 8, a heat dissipation device 50 according to one embodiment of the present disclosure is shown. The heat dissipation device 50 comprises a plurality of the ion generators as disclosed above. In the embodiment, the ion generators are connected in series, and the intensity of the ion flow and the airflow is enhanced. Correspondingly, the enhanced airflow ventilates the heat more quickly. Therefore, the heat dissipation device 50 provides a vast heat dissipation performance.

Figure 9:
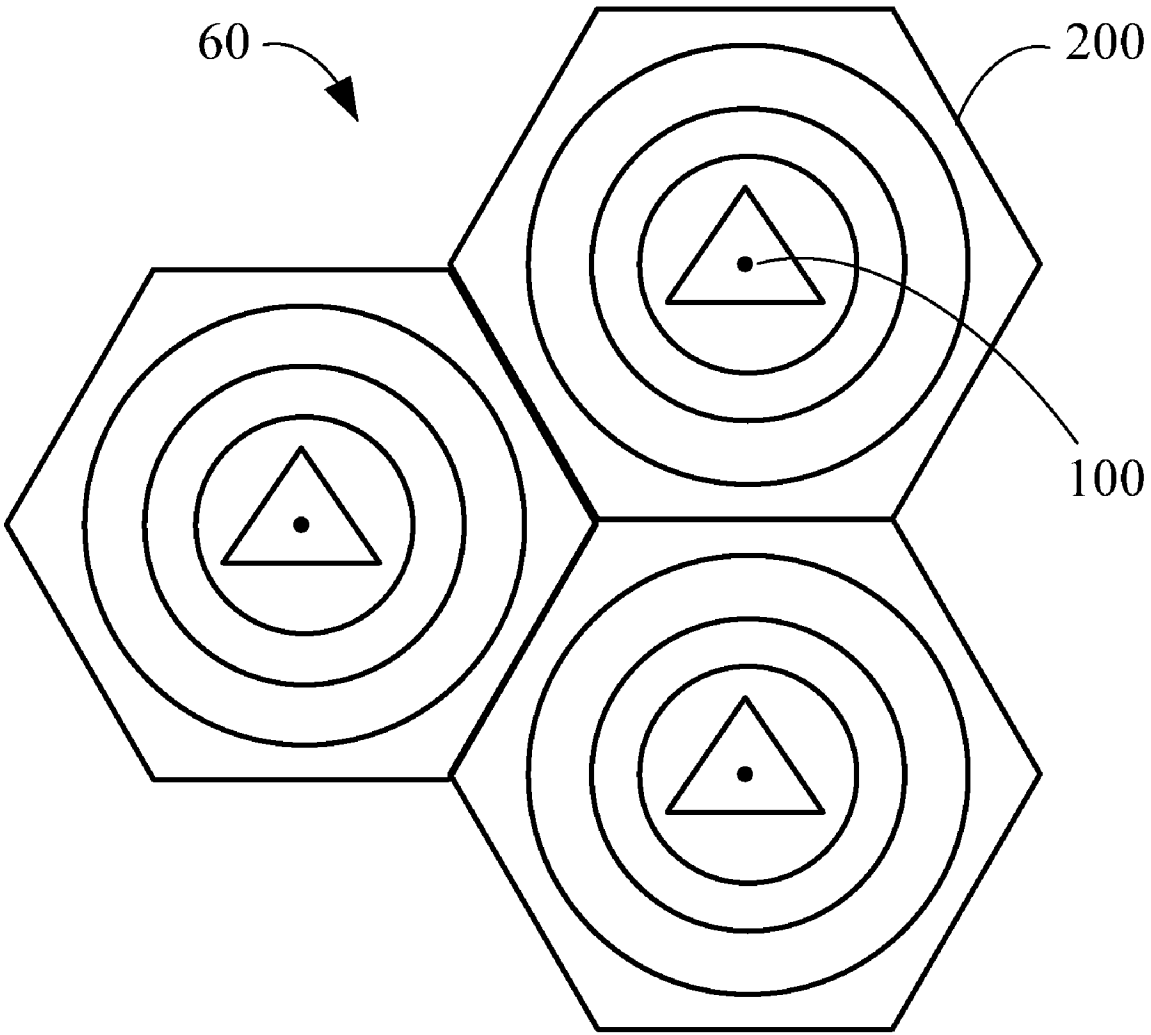
FIG. 9 illustrates a heat dissipation device of a second embodiment of the present disclosure.

In alternative embodiment, the ion generators are connected in parallel, which is shown in FIG. 9. Referring to FIG. 9, the amount of the ion flow and the airflow increases. Correspondingly, the increased airflow ventilates the heat more quickly. Therefore, the heat dissipation device 60 provides an improved heat dissipation performance.

It is apparent that embodiments of the present disclosure provide a heat dissipation device with an ion generator to generate ion flow to ventilate heat. Additionally, the heat is proportionality dispersed to flow channels by the ion flow for quick dissipation. Therefore, heat dissipation performance improves considerably.

It is believed that the present embodiments and their advantages will be understood from the foregoing description, and it will be apparent that various modifications, alternations, and changes may be made thereto without departing from the spirit and scope of the present disclosure, the examples hereinbefore described merely being preferred or exemplary embodiments of the present disclosure.

What is claimed is:

1. An ion generator, comprising:

an emitter comprising a needle electrode having one needle shaped tip configured as a discharging portion;

a receiver comprising a plurality of flow channels for airflow and at least one receiving portion, the at least one receiving portion comprising a line edge arranged around a concave spherical surface, the discharging portion being a substantial center of the concave spherical surface; and a power supply to provide a voltage potential difference between the discharging portion of the emitter and the at least one receiving portion of the receiver.

2. The ion generator as claimed in claim 1, wherein the receiver comprises a plurality of coaxial metal tubes electrically connected together, each coaxial metal tube comprises one end toward the discharging portion, and a line edge of the end of each coaxial metal tube is arranged around the concave spherical surface, interspaces between the coaxial metal tubes form the flow channels.

3. The ion generator as claimed in claim 2, wherein length of each of the coaxial metal tubes is variable.

4. The ion generator as claimed in claim 1, wherein the receiver comprises a swirling metal tube with one end toward the discharging portion, and a line edge of the end of the swirling metal tube is arranged around the concave spherical surface, interspaces of the swirling metal tube form the flow channels.

5. The ion generator as claimed in claim 4, wherein length of the swirling metal tube is variable.

6. The ion generator as claimed in the claim 1, wherein the receiver comprises a plurality of metal plates electrically connected together, each metal plate comprises one side toward the discharging portion, a line edge of the one side of each metal plate is arranged around the concave spherical surface, interspaces between the metal plates form the flow channels.

7. The ion generator as claimed in claim 6, wherein length of each metal plate is variable.

8. The ion generator as claimed in the claim 1, wherein the receiver comprises a metal board with a plurality of holes, the metal board comprises one surface toward the discharging portion, line edges on one surface of the metal board are arranged around the concave spherical surface, and holes of the metal board form the flow channels.

9. The ion generator as claimed in claim 8, wherein thickness of the metal board is variable.

10. A heat dissipation device, comprising:

a plurality of ion generator, each ion generator comprising:

an emitter comprising a needle electrode having one needle shaped tip configured as a discharging portion; and a receiver comprising a plurality of flow channels for airflow and at least one receiving portion, the at least one receiving portion comprising a line edge arranged around a concave spherical surface, the discharging portion being a substantial center of the concave spherical surface; and a power supply to provide a voltage potential difference for each ion generator.

11. The heat dissipation device as claimed in claim 10, wherein the plurality of ion generator are connected in series to enhance intensity of the ion flow.

12. The heat dissipation device as claimed in claim 10, wherein the plurality of ion generator are connected in parallel to increase amount of the ion flow.

13. The heat dissipation device as claimed in claim 10, wherein the receiver comprises a plurality of coaxial metal tubes electrically connected together, each coaxial metal tube comprises one end toward the discharging portion, and a line edge of the end of each coaxial metal tube is arranged around the concave spherical surface, interspaces between the coaxial metal tubes form the flow channels.

14. The heat dissipation device as claimed in claim 13, wherein length of each of the coaxial metal tubes is variable.

15. The heat dissipation device as claimed in the claim 10, wherein the receiver comprises a swirling metal tube with one end toward the discharging portion, and a line edge of the end of the swirling metal tube is arranged around the concave spherical surface, interspaces of the swirling metal tube form the flow channels.

16. The heat dissipation device as claimed in claim 15, wherein length of the swirling metal tube is variable.

17. The heat dissipation device as claimed in the claim 10, wherein the receiver comprises a plurality of metal plates electrically connected together, each of the metal plates comprises one side toward the discharging portion, a line edge of the side of each metal plates is arranged around the concave spherical surface, interspaces between the metal plates form the flow channels.

18. The heat dissipation device as claimed in claim 17, wherein length of each metal plate is variable.

19. The heat dissipation device as claimed in the claim 10, wherein the receiver comprises a metal board with a plurality of holes, line edges on one surface of the metal board are arranged around the concave spherical surface, and holes of the metal board form the flow channels.

20. The heat dissipation device as claimed in claim 19, wherein thickness of the metal board is variable.

* * * * *